US008648753B2

(12) United States Patent
Tamura

(10) Patent No.: US 8,648,753 B2
(45) Date of Patent: Feb. 11, 2014

(54) ANTENNA DEVICE

(75) Inventor: Nobuo Tamura, Novi, MI (US)

(73) Assignees: Mitsumi Electric Co., Ltd., Tokyo (JP); Mitsumi Electronics Corp., Tokyo (JP)

( * ) Notice: Subject to any disclaimer, the term of this patent is extended or adjusted under 35 U.S.C. 154(b) by 223 days.

(21) Appl. No.: 13/341,019

(22) Filed: Dec. 30, 2011

(65) Prior Publication Data

US 2013/0169489 A1 Jul. 4, 2013

(51) Int. Cl.
*H01Q 1/32* (2006.01)

(52) U.S. Cl.
USPC ..... 343/713; 343/711

(58) Field of Classification Search
USPC ..... 343/702, 711, 712, 713
See application file for complete search history.

(56) References Cited

U.S. PATENT DOCUMENTS 3,453,618 A * 7/1969 Kline et al. ..... 343/715
5,283,589 A * 2/1994 Blevins ..... 343/715
5,757,327 A * 5/1998 Yajima et al. ..... 343/713
7,304,614 B2 * 12/2007 Silva ..... 343/713
7,358,910 B2 * 4/2008 Blickle ..... 343/713
7,429,958 B2 * 9/2008 Lindackers et al. ..... 343/713
7,609,217 B2 * 10/2009 Noro et al. ..... 343/713
7,633,452 B2 12/2009 Noro et al.

FOREIGN PATENT DOCUMENTS

JP 2004-072320 A 3/2004

* cited by examiner

*Primary Examiner* — Tho G Phan
(74) *Attorney, Agent, or Firm* — Holtz, Holtz, Goodman & Chick, PC

(57) ABSTRACT

Disclosed is an antenna device including a base having an internal thread for an external thread, a first antenna element, a first circuit board which is arranged on the base, electrically connected to the first antenna element, and amplifies a signal output from the first antenna element, a shielding case arranged on the first circuit board, the shielding case having a top board, a second antenna element arranged on the top board of the shielding case and a second circuit board which is electrically connected to the second antenna element and amplifies a signal output from the second antenna element.

8 Claims, 11 Drawing Sheets

ANTENNA DEVICE

BACKGROUND ART

1. Field of the Invention

The present invention relates to an antenna device provided with two antenna elements.

2. Description of Related Art

Conventionally, as a car antenna device to be set on a vehicle roof, an antenna apparatus provided with a plurality of antennas such as for AM/FM radio broadcasting, for satellite radio broadcasting, for GPS (Global Positioning System), for telephone, for television broadcasting and so forth is known. By using these antennas, such antenna device can receive radio waves of a plurality of frequency bands.

Further, an antenna device provided with a rod antenna and a patch antenna is known as the above mentioned car antenna device. For example, there is known a car antenna device provided with a rod antenna for receiving AM/FM radio broadcasting and a circuit substrate for the rod antenna and also provided with two antenna units respectively for GPS and satellite radio broadcasting (see the specification of U.S. Pat. No. 7,633,452). Each antenna unit includes a patch antenna, a circuit board and a shielding case covering the circuit board. On each circuit board, a circuit element such as LNA (Low Noise Amplifier) to amplify the signal received by each antenna is mounted. Each antenna unit is mounted on the circuit board of the rod antenna. The circuit board of the rod antenna is screwed to a die-cast base having a fixation section for fixing the antenna device on the vehicle roof.

The patch antenna is constituted of a patch electrode, a grounding electrode, a dielectric board between the patch electrode and the grounding electrode and an electrode pin being connected with the patch electrode and penetrating the dielectric board. The gain of the patch antenna is increased by expanding the area of the grounding. There is known an antenna device provided with a patch antenna and a shielding case in which the circuit board of the patch antenna is housed and the patch antenna is provided on the top board of the shielding case, wherein the top board is overhung around the grounding electrode and the patch electrode is connected to the circuit board via the shielding case, in order to have a large are for grounding (see JP 2004-72320).

However, in the conventional antenna device provided with a rod antenna and patch antennas, the antenna units of the patch antennas are mounted on the circuit board of the rod antenna and the circuit board of the rod antenna is screwed onto the die-cast base. Therefore, a space for mounting the antenna units of the patch antennas on the circuit board of the rod antenna is needed in addition to a space for screwing the circuit board of the rod antenna onto the die-cast base. Therefore, a large space is used for the antenna.

Especially, when a shielding case in which the top board is larger than the area for the grounding electrode is used as in the case of the conventional patch antenna device where a patch electrode is connected to the circuit board via the shielding case, it is preferred that the space used for mounting the antenna units of the patch antennas on the circuit board of the rod antenna is smaller in order to realize space-saving in the antenna apparatus.

SUMMARY OF THE INVENTION

An object of the present invention is to realize space-saving in an antenna device.

To realize the above described object, the antenna device reflecting one aspect of the present invention includes a base having an internal thread for an external thread, a first antenna element, a first circuit board which is arranged on the base, electrically connected to the first antenna element, and amplifies a signal output from the first antenna element, a shielding case arranged on the first circuit board, the shielding case having a top board, a second antenna element arranged on the top board of the shielding case and a second circuit board which is electrically connected to the second antenna element and amplifies a signal output from the second antenna element, and the shielding case covers the second circuit board, the first circuit board includes a first fixation section for the external thread, the shielding case includes a second fixation section for the external thread, and the first circuit board and the shielding case are fixed to the base by the first fixation section and the second fixation section being screwed together due to the external thread being screwed into the internal thread.

Preferably, the antenna device further includes a top cover which covers the base, the first circuit board, the shielding case and the second antenna element, the top cover including a first antenna element connecting section where the first antenna element is to be connected.

Preferably, a first cable which electrically connects the first antenna element and the first circuit board, and a third fixation section which guides and fixes the first cable to an inner wall of the top cover.

Preferably, the first circuit board includes a connecting terminal, and the first cable is connected to the connecting terminal by soldering.

Preferably, the base includes a fourth fixation section which fixes the antenna device to a fixation opening in a setting surface of a vehicle, and a first hole for pulling a second cable and a third cable into the vehicle, one end of the second cable being electrically connected to the first circuit board and one end of the third cable being electrically connected to the second circuit board.

Preferably, the base comprises a shielding section which includes the internal thread and which covers the first circuit board, the shielding case comprises a second hole from which the second cable is pulled out, and the shielding section comprises a third hole to which the second cable is pulled in.

Preferably, the base comprises a shielding section which includes the internal thread and which covers the first circuit board.

Preferably, the top board of the shielding case has an inclination so that an axis perpendicular to a receiving surface of the second antenna element points a zenith direction when the antenna device is set.

BRIEF DESCRIPTION OF THE DRAWINGS

The above and other objects, advantages and features of the present invention will become more fully understood from the detailed description given hereinbelow and the appended drawings which are given by way of illustration only, and thus are not intended as a definition of the limits of the present invention, and wherein.

DESCRIPTION OF THE PREFERRED EMBODIMENT

Hereinafter, an embodiment of the present invention will be described in detail with reference to the drawings. However, the present invention is not limited to the examples shown in the diagrams in any way.

Figure 1:
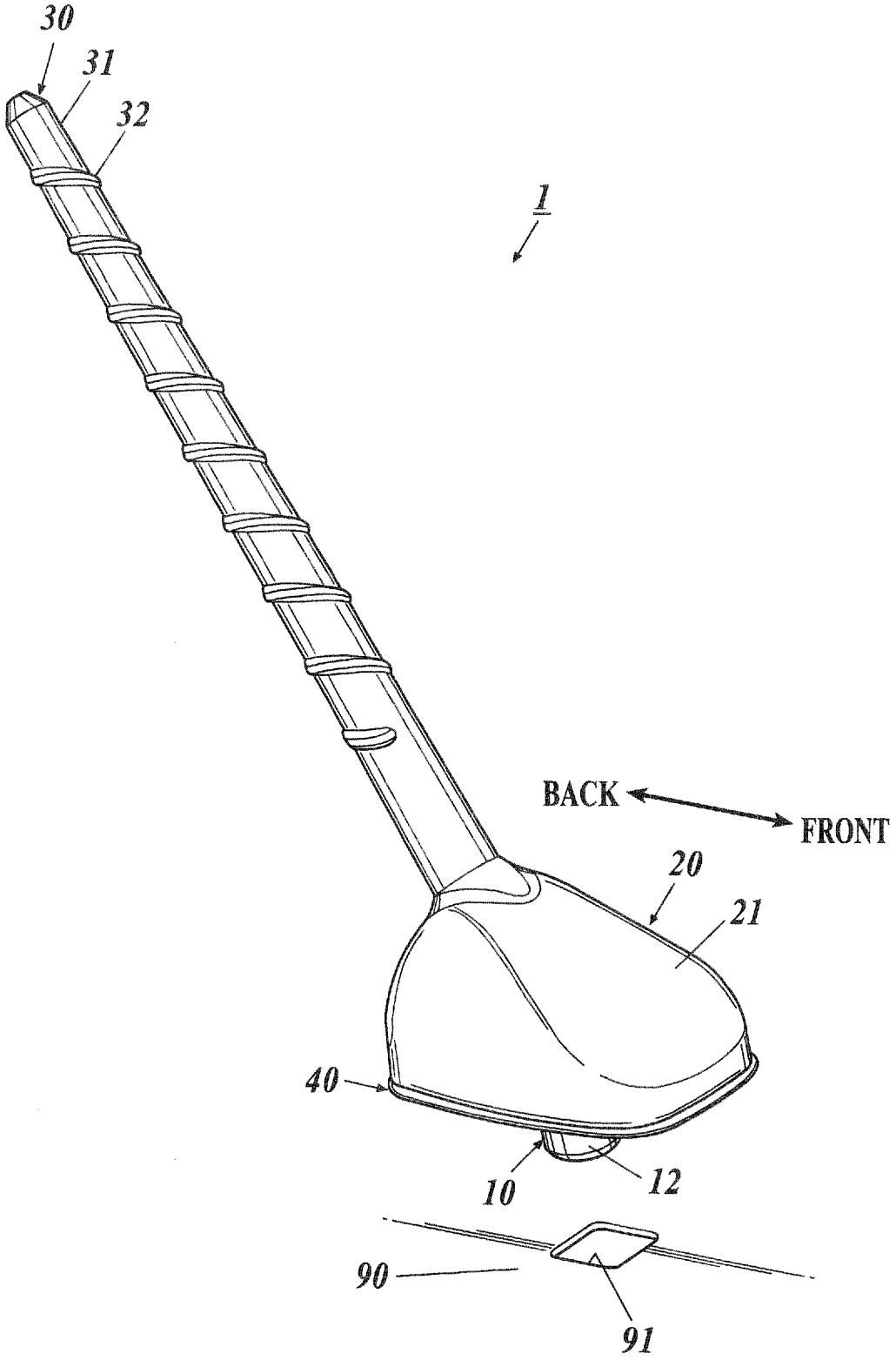
FIG. 1 is a schematic view of an antenna device and a setting surface according to an embodiment of the present invention.
Figure 2:
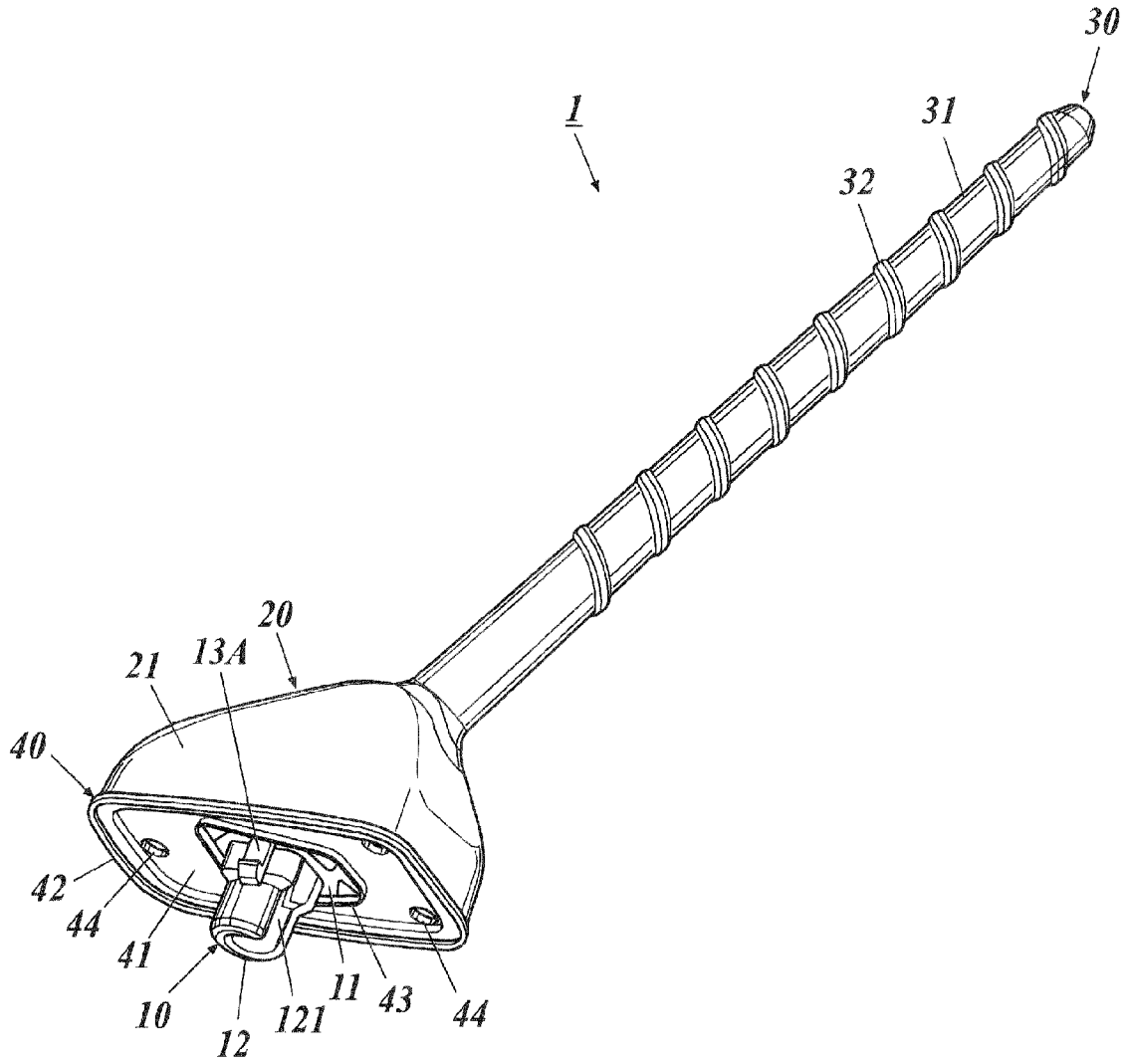
FIG. 2 is a schematic view when the antenna device is seen from diagonally below.

First, with reference to FIGS. 1 and 2, an outer structure of the antenna device 1 of the embodiment will be described. FIG. 1 is a schematic view of the antenna device 1 and the setting surface 90 according to the embodiment. FIG. 2 is a schematic view when the antenna device 1 is seen from diagonally below. The antenna device 1 shown in FIGS. 1 and 2 is a car antenna device to be set by being fixed on the setting surface 90 on the roof of a car (vehicle).

The antenna device 1 is an antenna device which can receive radio waves of frequency bands for receiving AM/FM radio broadcasting and satellite radio broadcasting. AM/FM radio broadcast is a broadcast where broadcasting radio wave is transmitted from a broadcasting station on the ground, and for example, the broadcasting radio wave is received by using a rod antenna. Satellite radio broadcasting is radio broadcasting such as XM satellite radio where broadcasting radio wave is transmitted from a broadcasting satellite, and for example, the broadcasting radio wave is received by using a patch antenna.

The antenna device 1 includes a rod antenna 30 as the first antenna element for receiving AM/FM radio broadcasting and a patch antenna 50 as the second antenna element for receiving the after-mentioned satellite radio broadcasting. However, the antenna device 1 is not limited to the above configuration, and an antenna device which includes at least two antenna elements such as a rod antenna and a patch antenna and which can receive radio waves of a plurality of frequency bands can be used as the antenna device 1. For example, the antenna device 1 may be configured such that the rod antenna 30 is used for receiving radio waves for terrestrial television broadcasting and telephone and the patch antenna 50 is used for receiving GPS (Global Positioning System) signals.

The antenna device 1 is constructed of a base 10, a top cover 20, a rod antenna 30 and a gasket 40.

The base 10 is a base to mount the after-mentioned patch antenna 50 and the like in the antenna device 1. Further, the base 10 has a function to fixate and set the antenna device 1 on the setting surface 90 of the vehicle roof. The base 10 includes a base main body 11, a fixation section 12 as the forth fixation section and hooks 13A.

Figure 6A:
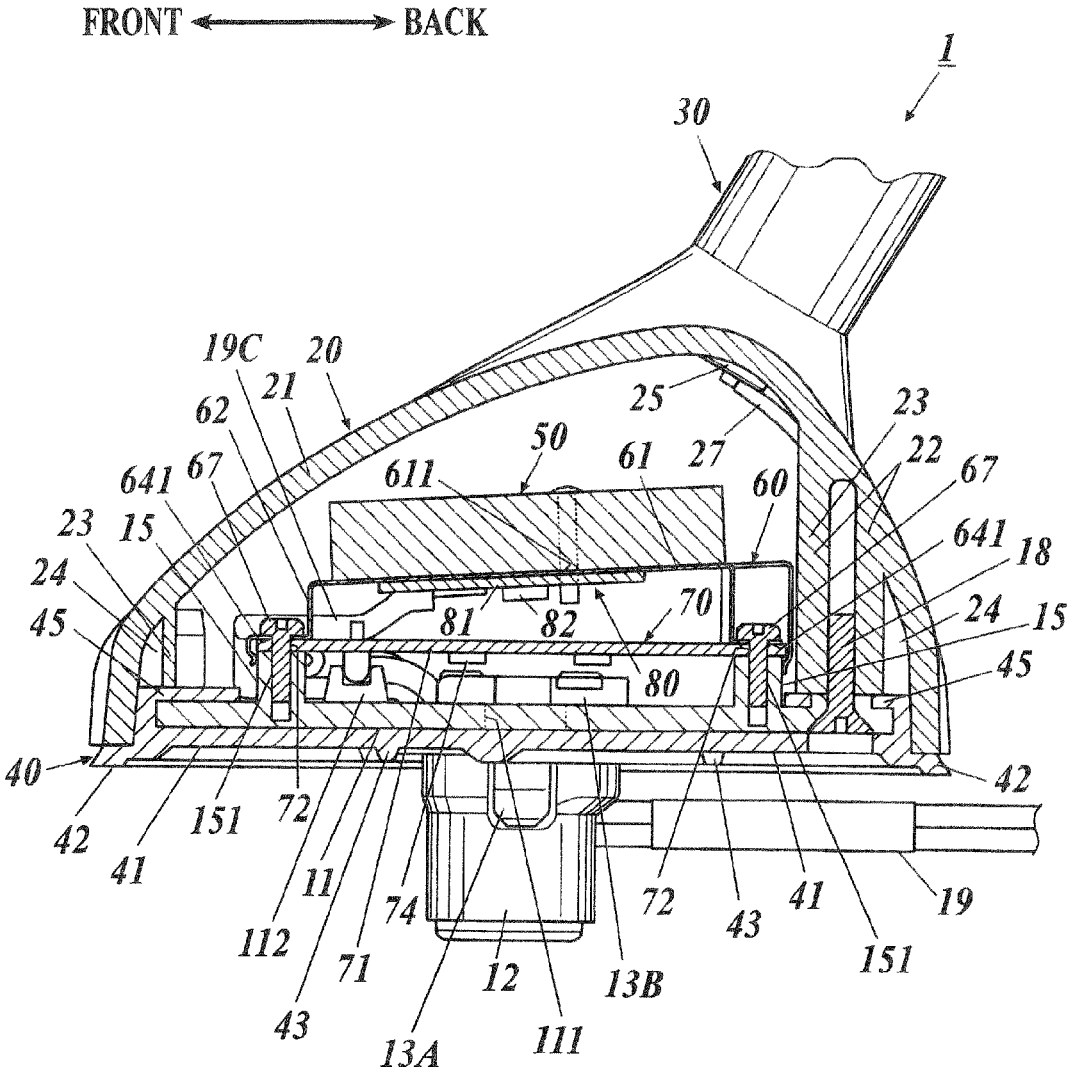
FIG. 6A is a cross sectional view of the antenna device.
Figure 7A:
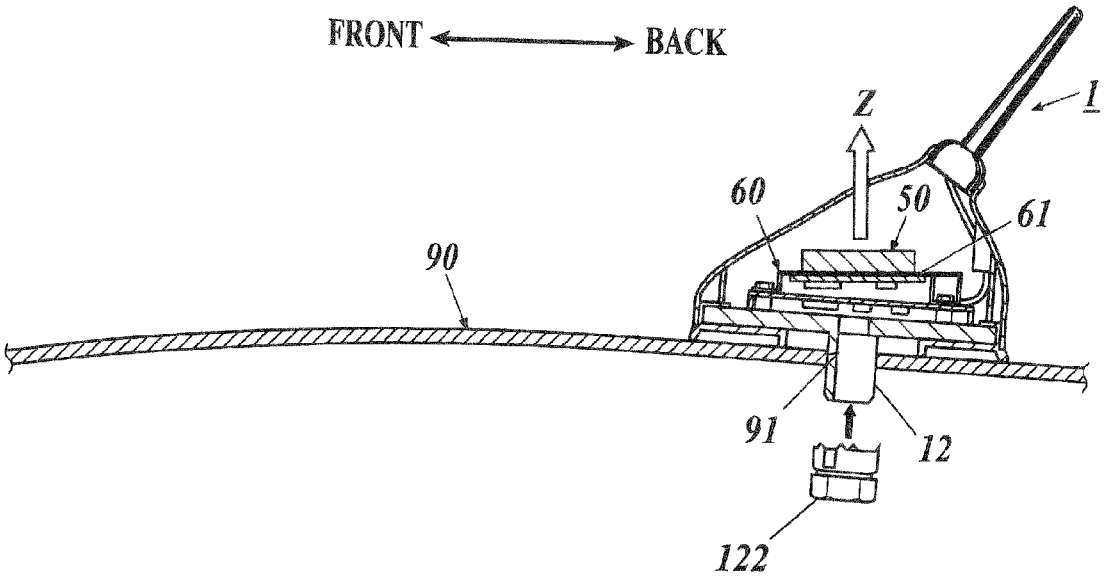
FIG. 7A is an outline of a cross sectional view of the antenna device attached to the setting surface.

The base main body 11 is a surface which forms the bottom of the antenna device 1 (the base 10). The fixation section 12 is a bolt-shaped member which is connected to the base main body 11 and wherein the axis thereof is in a direction perpendicular to the exposed plane (lower surface) of the base main body 11. Moreover, the fixation section 12 has a groove 121 formed along the axis direction of the fixation section 12. The fixation section 12 is fixed to the setting surface 90 of the vehicle roof with the after-mentioned tooth lock washer nut 122 (FIG. 7A). By the tooth lock washer nut 122 being fastened along the groove 121, the painted surface of the roof is penetrated and the GDN (grounding) is fully ensured from the setting surface 90 to the base 10 without damaging the after-mentioned cable 19 (FIG. 6A). The after-mentioned hole 111 is formed in the base main body 11 at the position corresponding to the groove 121 (FIG. 6A). The cable 19 is lead into the vehicle interior through the hole 111 and the groove 121. The space surrounded by the base 10 and the top cover 20 connects to a space (space inside of the vehicle when the antenna device 1 is attached to the vehicle) below the bottom of the base 10 through the hole 111 and the groove 121 of the base main body 11.

The base main body 11 and the fixation section 12 are metal die-casts of zinc or the like.

The hooks 13A are hooks made of resin or the like which are formed at the base main body 11. When the antenna device 1 is to be attached to the setting surface 90 of a vehicle, the antenna device 1 is temporarily fixed to the setting surface 90 by the hooks 13A sandwiching the setting surface 90 with the base main body 11.

The top cover 20 is a cover made of resin for covering the base 10 and the components mounted on the base 10. The top cover 20 includes a top cover main body 21. The top cover 20 is screwed onto the base 10 to which a gasket 40 is fit.

A rod antenna 30 is connected at the top portion of the top cover main body 21, and the top cover main body 21 is a cover which covers the base 10 on which a patch antenna 50 and the like are mounted.

The rod antenna 30 is an antenna for AM/FM radio broadcasting and is disposed so as to be tilted backward from a position being perpendicular to the bottom of the base 10. The rod antenna 30 includes a rod antenna main body 31 and a bulged portion 32.

The rod antenna main body 31 is an antenna main body formed in a rod-like shape in which the rod antenna's antenna element (not shown in the drawing) for AM/FM radio broadcasting is housed. The bulged portion 32 is formed in a spiral-shape along the axis of the rod antenna main body 31. The bulged portion 32 reinforces the rod antenna main body 31 and reduces wind noise when the vehicle is running after the antenna device 1 is set on the setting surface 90 of the vehicle.

The gasket 40 is a water-proof/dust-proof member for avoiding rain, dust and so forth from entering in the antenna device 1 and in the vehicle after the antenna device 1 is set on the setting surface 90 of the vehicle. The gasket 40 is made of elastic and is attached to the base main body 11. The gasket 40 includes a surface 41, ribs 42 and 43 and holes 44.

The surface 41 is a bottom which covers the base main body 11. The ribs 42 and 43 are the bottom ribs of the gasket 40, and the ribs 42 and 43 realize their water-proof/dust-proof functions by elastically deforming by being sandwiched between the base 10 and the setting surface 90 and sealing off the spaces in the antenna device 1 and the space inside the vehicle from outside when the antenna device 1 is set on the setting surface 90 of the vehicle. The rib 42 is formed at outer edge of the surface 41. The rib 43 is formed along the inner edge that exposes the base main body 11 around the fixation section 12 forming the shape of the inner edge. The holes 44 are holes formed in the surface 41 and are for the after-mentioned external threads 18 to go through.

Figure 3:
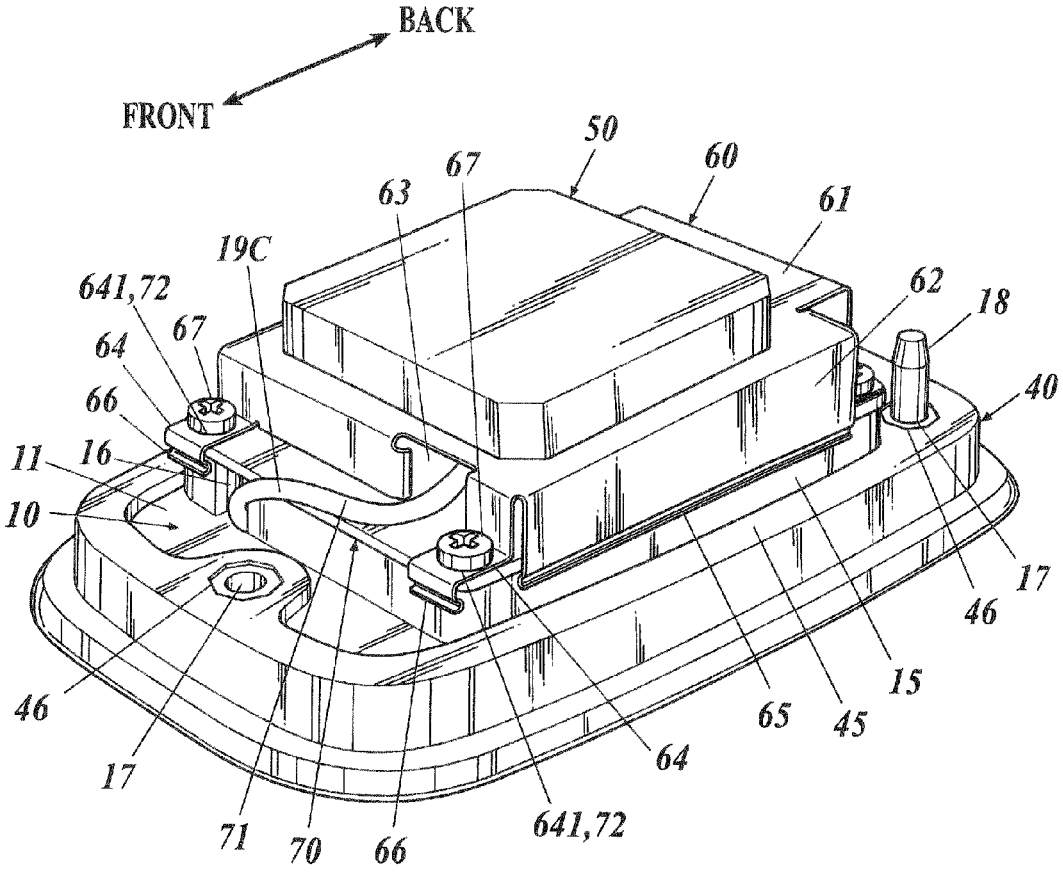
FIG. 3 is a schematic view when the antenna device in which the top cover is removed is seen from diagonally front.
Figure 4:
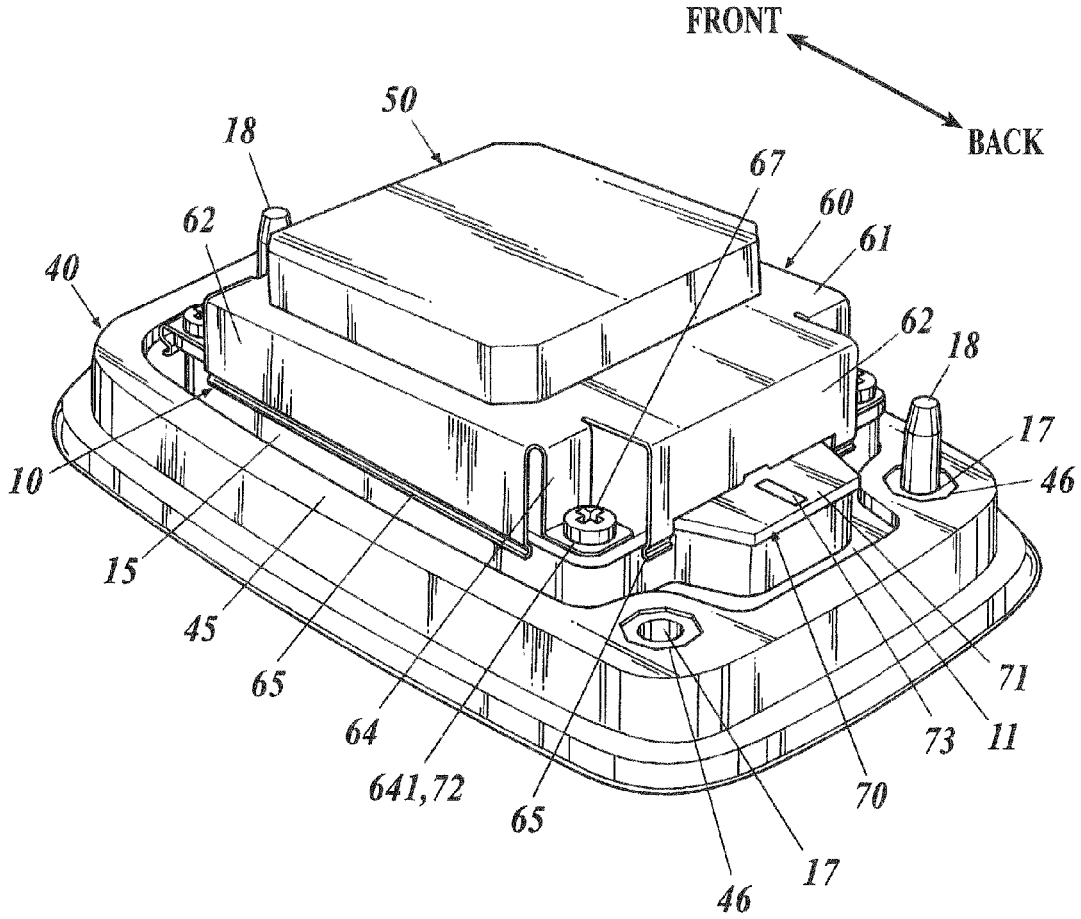
FIG. 4 is a schematic view when the antenna device in which the top cover is removed is seen from diagonally back.

Next, configuration of the antenna device 1 from which the top cover 20 is removed will be described with reference to FIGS. 3 and 4. FIG. 3 is a schematic view of the antenna device 1 from which the top cover 20 is removed, where the antenna device 1 is seen from diagonally front. FIG. 4 is a schematic view of the antenna device 1 from which the top cover 20 is removed, where the antenna device 1 is seen from diagonally back.

As shown in FIGS. 3 and 4, the antenna device 1 from which the top cover 20 is removed includes the base 10, the gasket 40, the patch antenna 50, a shielding case 60 and a circuit board 70.

The base 10 includes a shielding section 15 formed on the upper surface of the base main body 11, a hole 16 as the third hole and holes 17. The shielding section 15 is provided at side walls of a circuit element of the circuit board 70. The shielding section 15 is a shielding section which shields out an electric field from outside to prevent noise from being included in the signals of the circuit element of the circuit board 70 by the shielding section 15 covering the circuit element of the circuit board 70. The shielding section 15 is formed as a die-cast integrally with the base main body 11 and the fixation section 12. The shielding section 15 includes the after-mentioned internal threads 151 for screwing the external threads 67 thereto (FIG. 6A).

The hole 16 is a hole for pulling in the after-mentioned cable 19C wherein one end thereof is connected to the circuit of the after-mentioned circuit board 80 for patch antenna 50 (FIG. 3), and the hole 16 is formed in the shielding section 15. The holes 17 are screw holes for the external threads 18 to go through. The holes 44 of the gasket 40 are provided respectively at the positions corresponding to the holes 17. The external threads 18 are external screws for attaching the top cover 20 to the base 10.

The gasket 40 includes a convex section 45 and a hole 46 in the upper surface side of the surface 41. The convex section 45 is a convex section which covers the circumference portion of the upper surface of the base main body 11. The holes 46 are formed in the convex section 45 and are holes to expose the holes 17.

The patch antenna 50 is set on the shielding case 60, and the patch antenna 50 is an antenna which receives the radio wave transmitted from a radio broadcasting satellite such as XM. The patch antenna 50 is configured so as to have a substrate (not shown in the drawing) of a dielectric material, a magnetic material or a magnetic dielectric material between the grounding board (not shown in the drawing) and the patch electrode (not shown in the drawing) and to have a power supply pin which is connected to the patch electrode penetrating the substrate.

The shielding case 60 is made of metal, and the shielding case 60 is a shielding case which covers the after-mentioned circuit board 80 for the patch antenna 50 (FIG. 6A) and which shields out an electric field from outside by covering the circuit element of the circuit board 80 to prevent noise from being included in the signals of the circuit element of the circuit board 80. The shielding case 60 is grounded via the base 10, the external threads 67 and the circuit board 70 from the vehicle roof (the setting surface 90). Here, the shielding case 60 may be floated without being grounded, although it is preferred that the shielding case 60 is grounded. Further, the shielding case 60 is formed in an approximately box shape wherein the lower side is opened. The shielding case 60 includes a top board 61, side surfaces 62, a hole 63 as the second hole, legs 64 and hooks 65, 66.

The top board 61 is disposed in the upper surface side of the shielding section 15 and the circuit board 70, and the top board 61 is a board on which the patch antenna 50 is to be set. The power supply pin of the patch antenna 50 is connected to the circuit of the circuit board 80 via the after-mentioned hole 611 of the top board 61 (FIG. 6A).

The side surfaces 62 are boards disposed at the sides of the circuit board 80. The side surfaces 62 are connected to the edges of the circumference of the top board 61. The hole 63 is a hole for pulling out the cable 19C as the third cable connected to the circuit board 80. The cable 19C is a coaxial cable wherein one end thereof is electrically connected to the circuit of the after-mentioned circuit board 80 for the patch antenna 50 and the other end thereof is pulled into the vehicle through the fixation opening 91.

The legs 64 are legs for disposing the top board 61 on the circuit board 70. In each of the legs 64, a hole 641 as the second fixation section for the external thread 67 to go through is formed at the position corresponding to the internal thread 151 of the shielding section 15. The holes 641 are round holes. However, shape of the holes 641 is not limited to the round hole shape and may be other shapes such as half-circle shape. The hooks 65 are formed respectively at the edges of the side surfaces 62. The hooks 66 are formed respectively at the edges of the legs 64. The hooks 65 and 66 are used for determining the position of the shielding case 60 on the circuit board 70 by hooking the edges of the circuit board 70.

The circuit board 70 is a circuit board such as PCB (Printed Circuit Board) for a rod antenna 30, and a circuit element is mounted on the circuit board 70. The circuit board 70 includes a circuit board main body 71, holes 72 as the first fixation section and a connecting terminal 73. It is configured so that there is no component mounted on the upper surface of the circuit board 70 (the circuit board main body 71). However, the configuration is not limited to the above, and components may be mounted on the upper surface of the circuit board 70.

Figure 5:
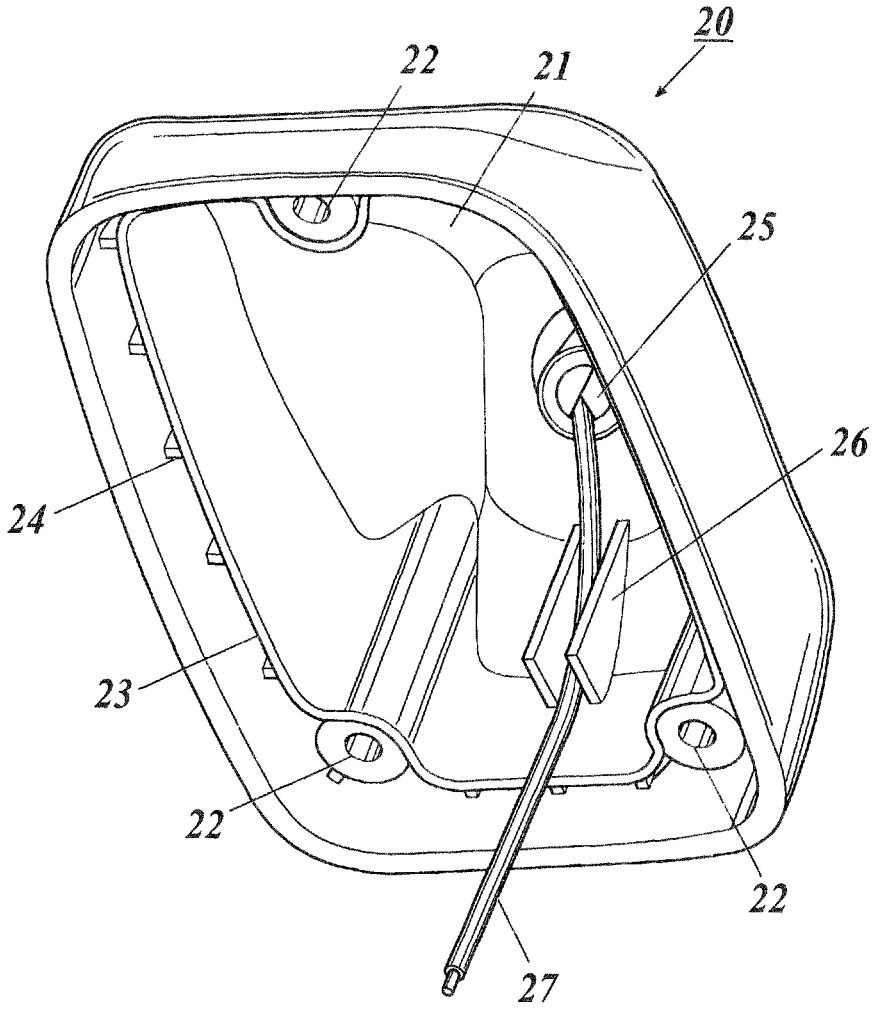
FIG. 5 is a schematic view showing the inside of the top cover.

The circuit board main body 71 is a board of glass epoxy or the like on which a circuit pattern for rod antenna 30 is wired. On the circuit board main body 71, a circuit element for processing the signals of AM/FM radio broadcasting received by the rod antenna 30 is mounted. The holes 72 are formed respectively at the positions corresponding to the internal threads of the shielding section 15, and the holes 72 are holes for the external threads 67 to go through. The holes 72 are round shape holes. However, shape of the holes 72 is not limited to the round shape and may be other shapes such as half circle shape. The connecting terminal 73 is a connecting terminal which is connected to the after-mentioned cable 27 connected to the rod antenna 30 (FIG. 5).

Next, configuration of inner side of the top cover 20 will be described with reference to FIG. 5. FIG. 5 is a schematic view showing the inner side of the top cover 20. As shown in FIG. 5, the tope cover 20 includes the top cover main body 21, internal threads 22, a water-proof rib 23, an enforcement rib 24, a nut 25 for connecting with the rod antenna, the fixation section 26 as the third fixation section and a cable 27 as the first cable.

The internal threads 22 are bosses in each of which an internal thread for screwing the external thread 18 is formed. The internal threads 22 are formed respectively at the positions corresponding to the holes in the base 10. By the external threads 18 being screwed to the holes 17 from the bottom of the base 10 through the holes 44 of the gasket 40 and being screwed to the internal threads 22 through the holes 46, the top cover 20 is attached to the base 10.

The water-proof rib 23 is a rib which is connected to the inner wall of the top cover main body 21 and extends to the opening side of the top cover main body 21. When the top cover 20 is attached to the base 10, the water-proof rib 23 deforms the convex section 45 by contacting the convex section 45 of the gasket 40 and pushing the convex section 45, and prevents water and dust from entering the space inside of the water-proof rib 23 in which the patch antenna 50 and the like are housed from outside.

The enforcement ribs 24 are a plurality of ribs which enforce the water-proof rib 23. The enforcement ribs 24 are connected to the inner wall of the top cover main body 21 and are extended in a direction perpendicular to the inner wall to connect with the water-proof rib 23.

The nut 25 for connecting the rod antenna is arranged toward upper part and in the back of the top cover main body 21, and the nut 25 is a connection for connecting the rod antenna 30.

The fixation section 26 is a guide/fixation member to guide and fix the cable 27. The fixation section 26 includes two approximately triangular plates arranged in parallel to each other being connected to the inner wall of the top cover main body 21 at a position corresponding to between the nut 25 for connecting the rod antenna and the connecting terminal 73 of the circuit board 70. The fixation section 26 fixes the cable 27 by the cable 27 being inserted between the two plates and by the two plates being welded. Moreover, the fixation section 26 guides the cable 27 along the inner wall of the top cover main body 21. The cable 27 is a covered conductor wherein one end thereof is electrically connected to the rod antenna 30 by being soldered to the nut 25 for connecting the rod antenna and the other end thereof is electrically connected to the connecting terminal 73 of the circuit board 70. The cable 27 includes a conductor wire and a covering layer that covers the conductor wire. The conductor wire of the cable 27 is connected to the connecting terminal 73 by soldering.

However, the configuration of the fixation section of the cable 27 is not limited to the above configuration of the fixation section 26. For example, the configuration may be such that the fixation section of the cable 27 is consisted of two plates arranged in parallel to each other, each of the two plates having a hook protruded toward the space formed between the two plates so that the cable 27 is prevented from coming off from the fixation section by the hooks when the cable 27 is inserted between the two plates.

Moreover, in a conventional antenna device, the circuit board for rod antenna and the rod antenna are to be connected by a spring contact being formed on the circuit board for rod antenna and inserting a metal plate or a metal wire which does not deform and which is electrically connected to the rod antenna in the metal spring contact. In the antenna device 1, because the cable 27 is soldered to the connecting terminal 73 of the circuit board 70, the electric connection can be assured than in the case of using the spring contact and reliability of the connection is ensured.

As shown in FIG. 4, the patch antenna 50 and the connecting terminal 73 of the circuit board 70 are arranged to be close to each other in the antenna device 1. When the patch antenna and the spring contact are positioned close to each other in the conventional antenna device, antenna characteristic of the patch antenna 50 will be influenced by the spring contact (and the metal plate or metal wire) connected to the rod antenna.

However, the cable 27 is a covered conductor in the antenna device 1, therefore the influence of the cable 27 (and the connecting terminal 73) on the antenna characteristic of the patch antenna 50 can be reduced by the covering layer of the cable 27.

Further, when the cable 27 is moving and is not stabilized in the top cover 20, the antenna characteristic of the rod antenna 30 is not stabilized either. However, the cable 27 is fixed to the inner wall of the top cover main body 21 by the fixation section 26. Therefore, the antenna characteristic of the rod antenna 30 is also stabilized.

Figure 6B:
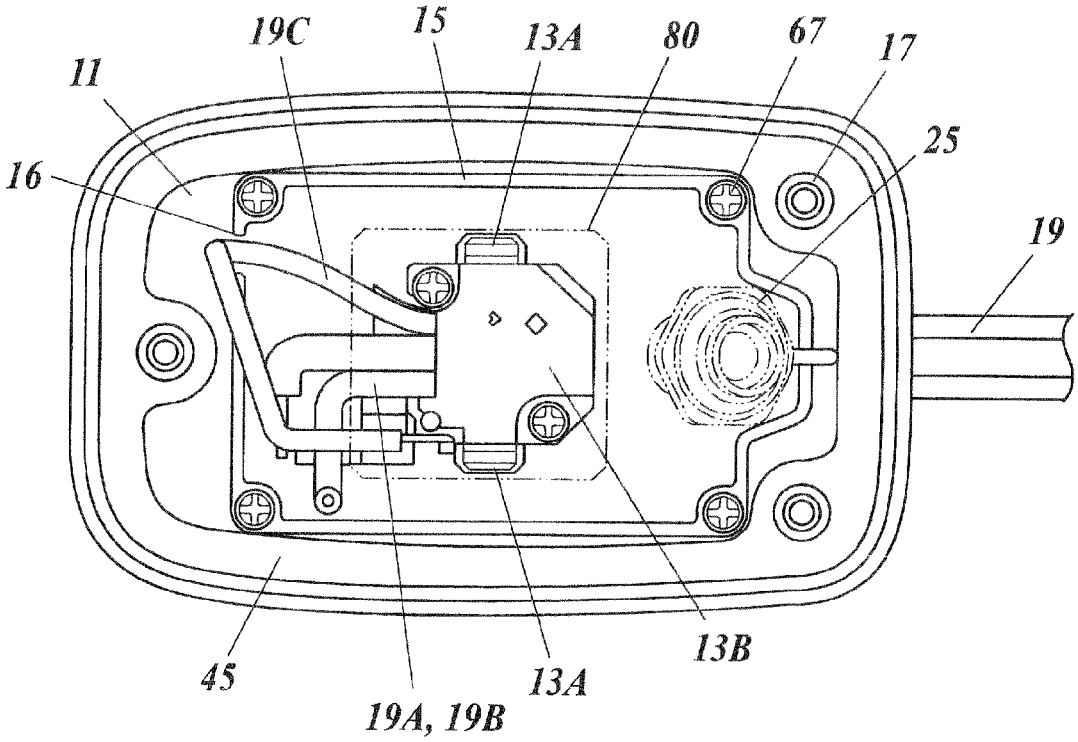
FIG. 6B is a transparent view of the antenna device.

Next, sectional configuration of the antenna device 1 will be described with reference to FIGS. 6A and 6B. FIG. 6A is a sectional view showing the antenna device 1. FIG. 6B is a transparent view showing the antenna device 1.

As shown in FIG. 6A, the antenna device 1 includes the circuit board 80 in addition to the base 10, the top cover 20, the rod antenna 30, the gasket 40, the patch antenna 50, the shielding case 60 and the circuit board 70.

The circuit board 80 is a circuit board such as PCB for the patch antenna 50. The circuit board 80 includes a circuit board main body 81 and a circuit element 82.

The circuit board main body 81 is a board of glass epoxy or the like on which a circuit pattern for the patch antenna 50 is wired. The circuit element 82 is a circuit element for processing the signals of the satellite radio broadcasting received by the patch antenna 50. The circuit element 82 includes an amplifier circuit such as LNA (Low Noise Amplifier) which amplifies the signals of the satellite radio broadcasting. The circuit element 82 is mounted on the lower surface side of the circuit board main body 81.

The circuit board 80 is housed in the shielding case 60 so that the upper surface of the circuit board main body 81 be arranged on the lower surface side of the top board 61 of the shielding case 60. Moreover, the top board 61 includes a hole 611. The patch antenna 50 is mounted on the upper surface of the top board 61. The power feeding pin of the patch antenna 50 is connected to the circuit of the circuit board main body 81 through the hole 611. The grounding electrode of the patch antenna 50 is made to contact the shielding case 60 so that the grounding area of the patch antenna 50 be large.

Moreover, the circuit board 70 includes a circuit element 74 in addition to the circuit board main body 71, the holes 72 and the connecting terminal 73. The circuit element 74 is a circuit element for processing the signals of AM/FM radio broadcasting received by the rod antenna 30. The circuit element 74 includes an amplifier circuit or the like which amplifies the signals of AM/FM radio broadcasting. The circuit element 74 is mounted on the lower surface side of the circuit board main body 71.

Moreover, the shielding section 15 (and the base main body 11) of the base 10 includes the internal threads 151. The internal threads 151 are internal threads to which the external threads 67 are screwed respectively. In a state where the shielding case 60 on which the patch antenna 50 and the circuit board 80 are mounted is attached to the circuit board 70 by the hooks 65 and 66, the external threads 67 are screwed to the internal threads 151 through the holes 641 of the legs 64 and the holes 72 of the circuit board 70, respectively. By such screwing, the shielding case 60 and the circuit board 70 are fastened together and attached to the base 10. By screwing the circuit board 70 and the shielding case 60 together to the base 10, the circuit board 70 and the shielding case 60 are adhered tightly to each other and grounding of the shielding case 60 is obtained from the circuit board 70 via the external threads 67 and the hooks 65 and 66.

Moreover, the base main body 11 of the base 10 includes a hole 111 as the first hole at the position corresponding to the groove 121 of the fixation section 12. The cable 19C for satellite radio broadcasting which is connected to the circuit of the circuit board 80 is pulled out inside the vehicle through the hole 63 of the shielding case 60, the hole 16 of the base 10, the hole 111 and the fixation opening 91 of the setting surface 90. Similarly, the cables 19A and 19B as the second cable for AM/FM radio broadcasting connected to the circuit of the circuit board 70 are pulled out inside the vehicle through the hole 111 and the fixation opening 91.

Further, the base 10 includes a cable supporting section 112 which is formed on the base main body 11. The cable supporting section 112 is a member for supporting and determining the position of the cables 19A and 19B.

Furthermore, the base 10 includes a cable fixation section 13B above the fixation section 12. The cable fixation section 13B is formed integrally with the hooks 13A.

FIG. 6B is a transparent view when the antenna device 1 shown in FIG. 6A is seen from above. In FIG. 6B, the circuit board 80 is seen through and the shielding case 60 and the circuit board 70 are omitted in the drawing.

As shown in FIG. 6B, the cable fixation section 13B is arranged in the shielding section 15 so as to cover the hole 111, and the cable fixation section fixes the cables 19A, 19B and 19C. The cable fixation section 13B is screwed onto the base main body 11. The cables 19A, 19B and 19C are pulled out inside the vehicle by being bundled together as the cable 19.

Figure 7B:
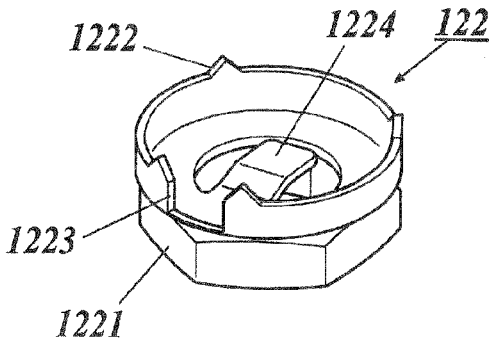
FIG. 7B is a schematic view showing a tooth lock washer nut.
Figure 7C:
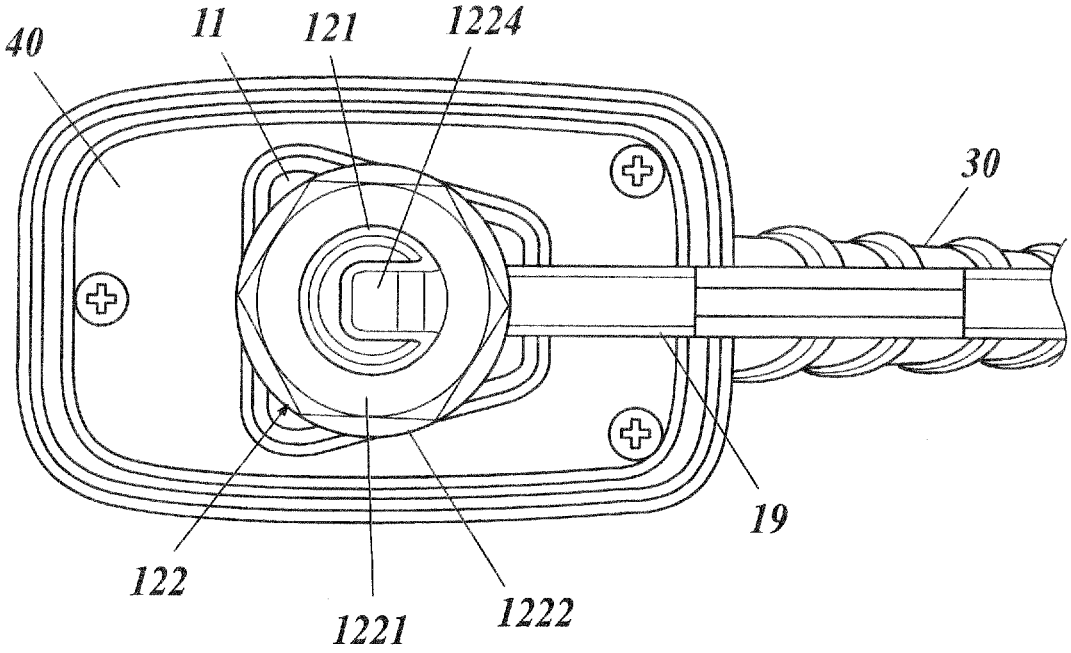
FIG. 7C is a bottom view of the antenna device to which the tooth lock washer nut is attached.
Figure 8A:
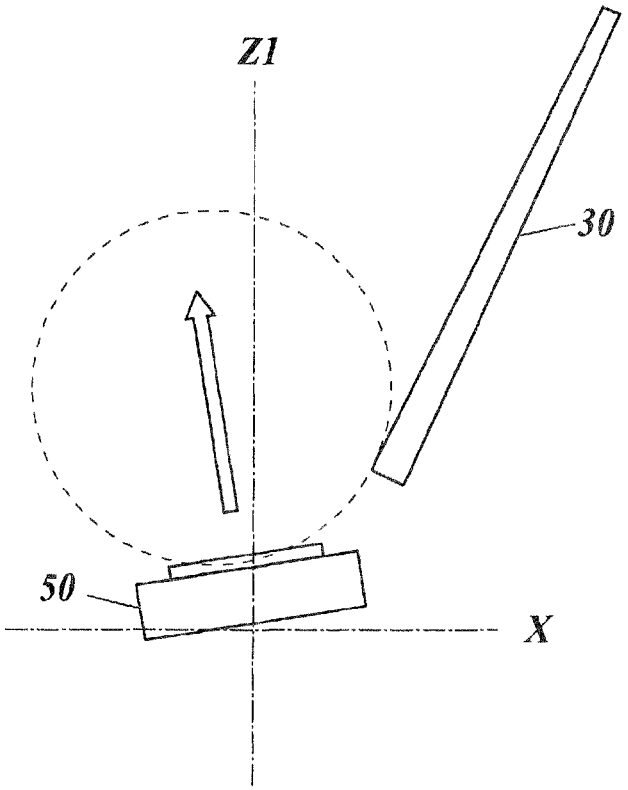
FIG. 8A is a side view showing the arrangement of a rod antenna and a patch antenna in the antenna device.
Figure 8B:
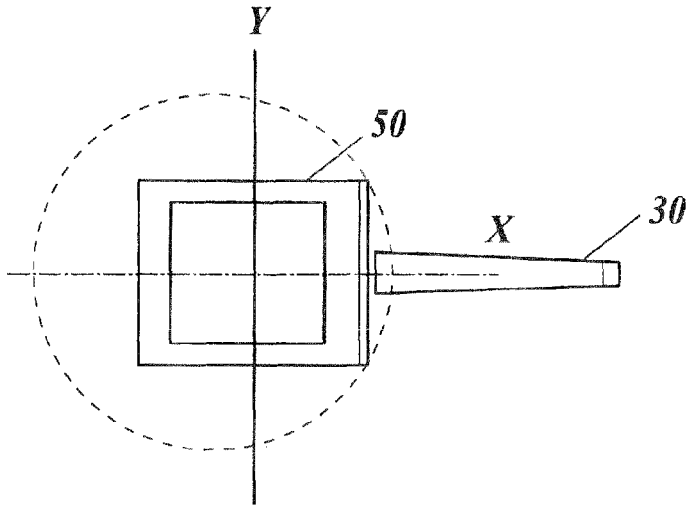
FIG. 8B is a plane view showing the arrangement of the rod antenna and the patch antenna in the antenna device.

Next, attachment of the antenna device 1 to the setting surface 90 of the vehicle roof will be described with reference to FIGS. 7A to 7C and FIGS. 8A and 8B. FIG. 7A is an outline of a cross sectional view of the antenna device 1 attached to the setting surface 90. FIG. 7B is a schematic view showing the tooth lock washer nut 122. FIG. 7C is a bottom view of the antenna device 1 to which the tooth lock washer nut 122 is attached. FIG. 8A is a side view showing the arrangement of the rod antenna 30 and the patch antenna 50 in the antenna device 1. FIG. 8B is a plane view showing the arrangement of the rod antenna 30 and the patch antenna 50 in the antenna device 1.

As shown in FIG. 7A, first, the fixation section 12 of the antenna device 1 is inserted in the fixation opening 91 in the setting surface 90 of the vehicle roof, the antenna device 1 being assembled to have the rod antenna 30 and the patch antenna 50 mounted thereon. Then, by the tooth lock washer nut 122 being fastened to the fixation section 12, the antenna device 1 is fixed and attached to the setting surface 90.

As shown in FIG. 7B, the tooth lock washer nut 122 includes a nut 1221, a teeth section 1222, a hole 1223 and a cable pressing protrusion 1224.

The nut 1221 is a nut which corresponds to the bolt of the fixation section 12. The teeth section 1222 has teeth which bite into the setting surface 90 and is arranged at the position corresponding to the approximately external periphery of the cross section of the nut 1221. The hole 1223 is a hole formed by cutting out a part of the teeth section 1222, and the cable 19 which went through the groove 122 is pulled through the hole.

The cable pressing protrusion 1224 is arranged at the center of the teeth section 1222 and is a spring shaped protrusion which presses the cable 19 which went through the groove 122.

As shown in FIG. 7C, in a state where the fixation section 12 of the antenna device 1 is inserted in the fixation opening 91 and where the cable 19 is pulled out from the groove 122, the nut 1221 of the tooth lock washer nut 122 is fastened to the bolt of the fixation section 12. At this time, the position of the hole 1223 can be matched with the position of the groove 122. Therefore, the cable 19 is pulled out from the hole 1223. As the nut 1221 being fastened, the nut 1221 rotates centering around the axis of the fixation section 12. However, the teeth section 1222, the hole 1223 and the cable pressing protrusion 1224 do not rotate. As the nut 1221 being fastened, the cable pressing protrusion 1224 presses the cable 19 which is pulled out from the hole 1223 to the base main body 11 side. Therefore, the position of the cable 19 can be determined so that the direction to which the cable 19 is to be pulled out from the fixation section 12 be in the direction parallel to the fixation surface 90.

As shown in FIG. 6A, the circuit board main body 71 of the circuit board 70 is arranged at the position parallel to the base main body 11 of the base 10 when seen from the side. In contrary, the top board 61 of the shielding case 60 and the patch antenna 50 are arranged so as to have inclination where the distance from the base main body 11 increases gradually toward the back when seen from the side.

That means, as shown in FIG. 7A, the setting surface 90 of the vehicle roof at the attachment position of the antenna device 1 gradually lowers toward the back. Therefore, in a state where the antenna device 1 is attached to the setting surface 90, the axis perpendicular to the receiving surface (plane surface) of the patch antenna 50 is in the zenith direction Z due to the arrangement of the top board 61 with inclination. Therefore, when the patch antenna 50 receives radio wave of satellite radio broadcasting from a satellite in the zenith direction Z, sensitivity of the antenna can be improved.

In FIGS. 8A and 8B, the axis in the front-back direction parallel to the plane surface of the base main body 11 of the base 10 in the antenna device 1 shown in FIG. 6A is the X axis, and the axis perpendicular to the plane surface of the base main body 11 is the Z1 axis. In FIG. 8B, the axis parallel to the plane surface of the base main body 11 of the base 10 and perpendicular to the front-back direction in the antenna device 1 shown in FIG. 6A is the Y axis. Further, in FIGS. 8A and 8B, the arrow indicates the radiation direction of radio waves of the patch antenna 50, and the dotted line shows the radiation pattern of radio waves of the patch antenna 50.

In FIG. 8A, the receiving surface (plane surface) of the patch antenna 50 in the antenna device 1 is inclined with respect to the X axis and the radiation direction of the patch antenna 50 is also inclined with respect to the Z1 axis. Therefore, as shown in FIGS. 8A and 8B, the radiation pattern of the patch antenna 50 is spherical and is not influenced by the rod antenna 30. Thus, when the patch antenna 50 receives radio wave of the satellite radio broadcasting from a satellite in the zenith direction Z, degradation in sensitivity of the antenna can be prevented.

When considering a case where the receiving surface (plane surface) of the patch antenna 50 in the antenna device 1 is arranged so as not to have inclination with respect to the X axis, in such arrangement, the radiation direction of the patch antenna 50 will not have inclination with respect to the Z1 axis. Therefore, a part of the rod antenna 30 enters the spherical radiation pattern of the patch antenna 50 and the right side of the radiation pattern in the X-Y plane surface indents due to the influence of the rod antenna 30. Thus, sensitivity of the antenna is degraded when the patch antenna 50 received radio wave of the satellite radio broadcasting from the satellite in the zenith direction Z.

Figure 9:
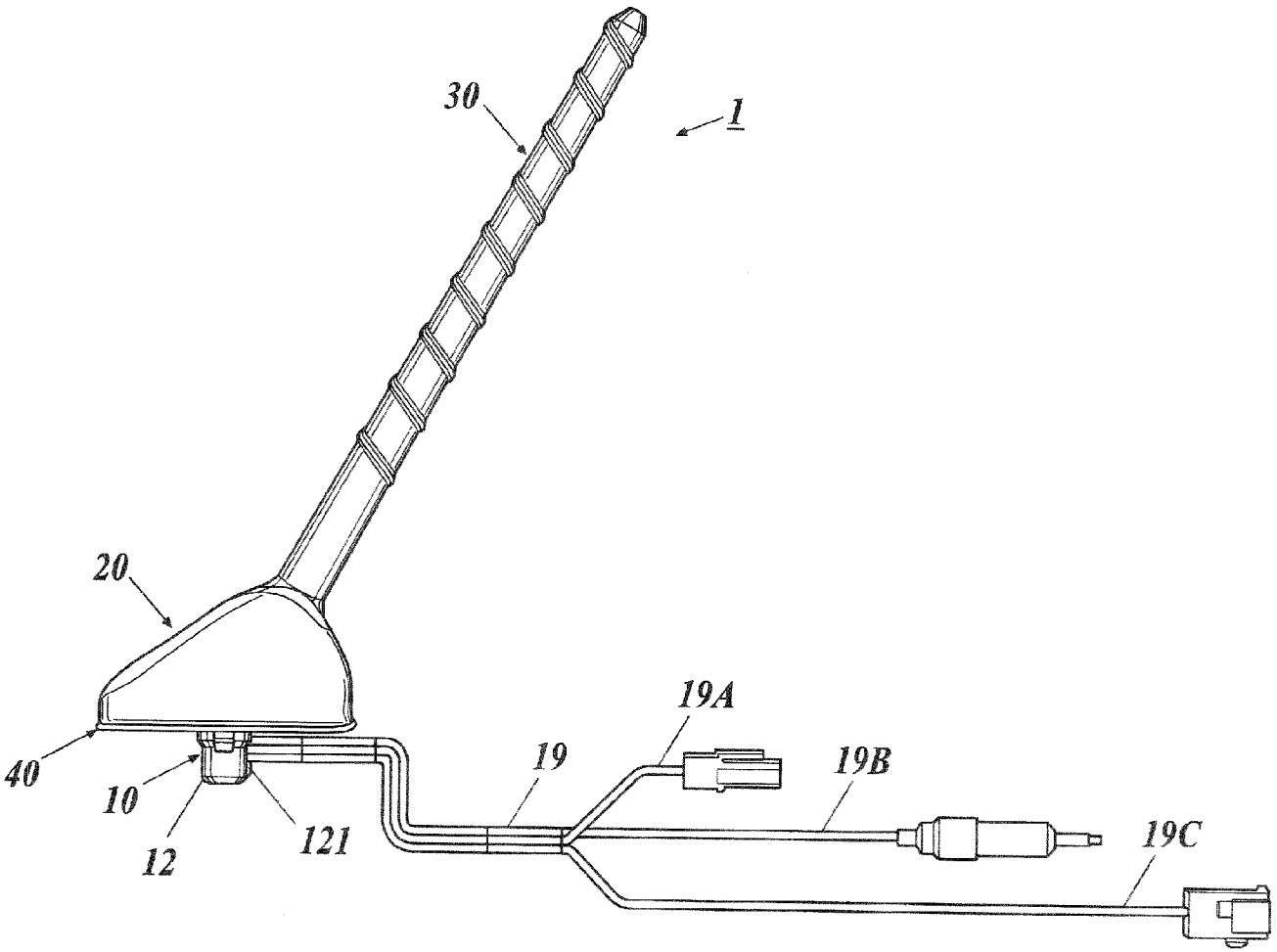
FIG. 9 is a side view showing the antenna device and cables.

Next, the cable 19 which is to be pulled out from the antenna device 1 will be described with reference to FIG. 9. FIG. 9 is a side view showing the antenna device 1 and the cable 19.

The cable 19C, the cable 19A and the cable 19B are pulled out as the cable 19 through the hole 111 of the base 10 and the groove 121 of the fixation section 12. Here, the cable 19C is a signal wire and a power wire for satellite radio, wherein one end thereof is electrically connected to the circuit board 80, which is pulled out from the hole 63 of the shielding case 60 and pulled into the hole 16 of the shielding section 15, the cable 19A is a power wire for AM/FM wherein one end thereof is electrically connected to the circuit board 70, and the cable 19B is a signal wire for AM/FM wherein one end thereof is electrically connected to the circuit board 70. At the other ends of the three cables, which are the cables 19A, 19B and 19C of the cable 19, there are respectively formed a power wire connector for connecting with AM/FM radio broadcasting receiver, a signal wire connector and a satellite radio connector for connecting with satellite radio broadcasting receiver.

The cable 19 is pulled out inside the vehicle in a state where the antenna device 1 is attached to the setting surface 90 of the vehicle by fixing the fixation section 12 in the fixation opening 91. Then, the connectors of the cables 19A and 19B are connected to the AM/FM radio broadcasting receiver which is provided inside the vehicle. The connector of the cable 19C is connected to the satellite radio broadcasting receiver.

According to the above embodiment, in the antenna device 1, the shielding case 60 is arranged on the circuit board 70 which is electrically connected to the rod antenna 30, the patch antenna 50 is arranged on the top board 61 of the shielding case 60, the shielding case 60 covers the circuit board 80 which is electrically connected to the patch antenna 50, and the circuit board 70 and the shielding case 60 are fixed to the base 10 due to the holes 641 and the holes 72 being respectively fastened together by screwing the external threads 67 in the internal threads 151. That is, due to the fastening together by making the external threads 67 respectively go through the holes 641 and the holes 72 and screwing into the internal threads 151, the circuit board 70 and the shielding case 60 are fixed to the base 10. Therefore, the area in the base 10 where the circuit board 70 is attached and the area in the circuit board 70 (the base 10) where the shielding case 60 is attached can be used commonly. Therefore, space-saving can be realized in the antenna device 1.

Moreover, the antenna device 1 includes the base 10 to which the rod antenna 30 is connected, the circuit board 70, the shielding case 60 (and the circuit board 80) and the tope cover 20 which covers the patch antenna 50. Therefore, the base 10, the circuit board 70, the shielding case 60 (the circuit board 80) and the patch antenna 50 can be protected from external forces.

Further, the top cover 20 includes the covered conductor cable 27 which electrically connects the rod antenna 30 (the nut 25 for connecting rod antenna) and the circuit board 70 (the connecting terminal 73) and the fixation section 26 which guides and fixes the cable 27 to the inner wall of the top cover 20 (the top cover main body 21). Therefore, influence of the cable 27 on the antenna characteristic of the patch antenna 50 can be reduced and the connecting terminal 73 and the patch antenna 50 can be disposed close to each other. Thus, further space-saving can be realized in the antenna device 1. Furthermore, because the cable 27 is fixated, the antenna characteristic of the rod antenna 30 can be stabilized.

Moreover, the base 10 includes the internal threads 151 and is provided with the shielding section 15 which covers the circuit board 70. Therefore, noise can be prevented from being included in the signals of the circuit board 70, and the circuit board 70 can be attached to the base 10 (the shielding section 15) easily.

Further, the circuit board 70 includes the connecting terminal 73, and the cable 27 is connected to the connecting terminal 73 by soldering. Therefore, the cable 27 can be electrically connected to the connecting terminal 73 surely and reliability of the connected can be ensured. Further, the space for the connecting terminal 73 is smaller than the spring contact. Thus, further space-saving can be realized in the antenna device 1.

Furthermore, the shielding case 60 includes the hole 63 through which the cable connected to the circuit board 80 is pulled out, and the base 10 (the shielding section 15) includes the hole 16 in which the cable which is pulled out from the hole 63 is to be pulled in. Therefore, the cable which is connected to the circuit board 80 can be routed easily to the hole 111 of the base 10.

Moreover, in a state where the antenna device 1 is set on the setting surface 90 of the vehicle, the top board 61 of the shielding case 60 is inclined in a way that the axis perpendicular to the receiving surface of the patch antenna 50 points the zenith direction. Therefore, receiving sensitivity of the patch antenna 50 can be improved. Further, degradation in receiving sensitivity of the patch antenna 50 due to the rod antenna 30 can be prevented.

In the above, the present invention accomplished by the inventor is described in detail based on the embodiment. However, the present invention is not limited to the above described embodiment and can be changed within the scope of the invention.

The above disclosed embodiment is an example in all aspects and is not limitative in anyway. The present invention is described by the scope of the claims and not by the above description, and all modifications within the scope of equivalents of the claims are included.

What is claimed is:

1. An antenna device, comprising:

a base having an internal thread for an external thread;

a first antenna element;

a first circuit board which is arranged on the base, electrically connected to the first antenna element, and amplifies a signal output from the first antenna element;

a shielding case arranged on the first circuit board, the shielding case having a top board;

a second antenna element arranged on the top board of the shielding case; and a second circuit board which is electrically connected to the second antenna element and amplifies a signal output from the second antenna element, wherein the shielding case covers the second circuit board, the first circuit board includes a first fixation section for the external thread, the shielding case includes a second fixation section for the external thread, and the first circuit board and the shielding case are fixed to the base by the first fixation section and the second fixation section being screwed together due to the external thread being screwed into the internal thread.

2. The antenna device as claimed in claim 1, further comprising a top cover which covers the base, the first circuit board, the shielding case and the second antenna element, the top cover including a first antenna element connecting section where the first antenna element is to be connected.

3. The antenna device as claimed in claim 2, wherein the top cover comprises a first cable which electrically connects the first antenna element and the first circuit board, and a third fixation section which guides and fixes the first cable to an inner wall of the top cover.

4. The antenna device as claimed in claim 3, wherein the first circuit board includes a connecting terminal, and the first cable is connected to the connecting terminal by soldering.

5. The antenna device as claimed in claim 1, wherein the base comprises a fourth fixation section which fixes the antenna device to a fixation opening in a setting surface of a vehicle, and a first hole for pulling a second cable and a third cable into the vehicle, one end of the second cable being electrically connected to the first circuit board and one end of the third cable being electrically connected to the second circuit board.

6. The antenna device as claimed in claim 5, wherein the base comprises a shielding section which includes the internal thread and which covers the first circuit board, the shielding case comprises a second hole from which the second cable is pulled out, and the shielding section comprises a third hole to which the second cable is pulled in.

7. The antenna device as claimed in claim 1, wherein the base comprises a shielding section which includes the internal thread and which covers the first circuit board.

8. The antenna device as claimed in claim 1, wherein the top board of the shielding case has an inclination so that an axis perpendicular to a receiving surface of the second antenna element points a zenith direction when the antenna device is set.

* * * * *